US009488439B2

(12) United States Patent
Galli et al.

(10) Patent No.: US 9,488,439 B2
(45) **Date of Patent: *Nov. 8, 2016**

(54) PISTOL MOUNTED LIGHT AND OPERATION THEREOF

(71) Applicant: Emissive Energy Corporation, North Kingstown, RI (US)

(72) Inventors: Robert D. Galli, North Kingstown, RI (US); Christopher J. O'Brien, Wakefield, RI (US)

(73) Assignee: EMISSIVE ENERGY CORP., North Kingstown, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/401,401

(22) PCT Filed: May 17, 2013

(86) PCT No.: PCT/US2013/041644

§ 371 (c)(1),
(2) Date: Nov. 14, 2014

(87) PCT Pub. No.: WO2013/173750

PCT Pub. Date: Nov. 21, 2013

(65) Prior Publication Data

US 2015/0124436 A1 May 7, 2015

Related U.S. Application Data

(60) Provisional application No. 61/648,134, filed on May 17, 2012.

(51) Int. Cl.

| | |
|---|---|
| ***F41G 1/35*** | (2006.01) |
| ***F21V 23/04*** | (2006.01) |
| ***F41G 11/00*** | (2006.01) |

(Continued)

(52) U.S. Cl.

CPC ..... *F41G 1/35* (2013.01); *F21V 23/0414* (2013.01); *F41G 11/003* (2013.01); *F21W 2131/40* (2013.01); *F21Y 2105/001* (2013.01)

(58) Field of Classification Search

CPC .... F41G 1/35; F41G 11/003; F21V 23/0414; F21W 2131/40; F21Y 2105/001

USPC ..... 362/110; 42/114, 117, 146

See application file for complete search history.

(56) References Cited

U.S. PATENT DOCUMENTS 5,581,898 A * 12/1996 Thummel ..... F41G 1/35 42/114
5,758,448 A * 6/1998 Thummel ..... F41G 1/36 362/114
6,185,854 B1 * 2/2001 Solinsky ..... F41G 1/35 362/110

(Continued)

*Primary Examiner* — Renee Chavez
*Assistant Examiner* — Colin Cattanach
(74) *Attorney, Agent, or Firm* — Barlow, Josephs & Holmes, Ltd.

(57) ABSTRACT

A novel flashlight assembly that includes an interface integrated into the housing thereof to facilitate mounting of the flashlight to the interface positioned ahead of the trigger on a modern firearm. Generally, the outer body of the flashlight includes a head mounted to a flashlight body at one end and at least one paddle switch extending outwardly at the other end of the body. Preferably the paddle switch extends at least partially beyond a trigger guard on the firearm when the flashlight is mounted to the accessory interface on the firearm. Further, the flashlight includes protrusions extending from the side of the body for interfacing the flashlight with the accessory interface on the firearm.

12 Claims, 9 Drawing Sheets

(51) Int. Cl.
*F21W 131/40* (2006.01)
*F21Y 105/00* (2016.01)

(56) References Cited

U.S. PATENT DOCUMENTS 7,260,912 B2 * 8/2007 Liu ..... F41G 11/003 42/124
7,305,790 B2 * 12/2007 Kay ..... F41G 11/003 42/114
7,735,255 B1 * 6/2010 Kincaid ..... F41G 1/35 362/110
8,510,979 B1 * 8/2013 Mortimer ..... F41H 9/10 42/1.08
2006/0104064 A1 * 5/2006 Sharrah ..... F21S 9/02 362/287
2007/0193103 A1 * 8/2007 Cheng ..... F41G 11/003 42/111
2007/0202468 A1 * 8/2007 Iwasawa ..... F41G 1/35 434/21
2007/0227056 A1 * 10/2007 Howe ..... F41G 11/003 42/146
2008/0040965 A1 * 2/2008 Solinsky ..... F41G 11/003 42/90
2009/0139846 A1 * 6/2009 Faifer ..... H01H 19/635 200/336
2009/0307955 A1 * 12/2009 NuDyke ..... F41C 27/00 42/117
2010/0097789 A1 * 4/2010 Sharrah ..... F21S 9/02 362/110
2010/0164401 A1 7/2010 Matthews et al.
2010/0176741 A1 * 7/2010 Sharrah ..... F21V 21/0885 315/291
2011/0146128 A1 6/2011 Haering
2011/0173866 A1 7/2011 Matthews et al.
2012/0167436 A1 * 7/2012 Westra ..... F41G 11/004 42/90
2015/0159847 A1 * 6/2015 Galli ..... F21V 23/0414 362/111

* cited by examiner

PISTOL MOUNTED LIGHT AND OPERATION THEREOF

CROSS-REFERENCE TO RELATED APPLICATIONS

This application is related to and claims priority from earlier filed U.S. Provisional Patent Application No. 61/648,134, filed 17 May 2012.

BACKGROUND OF THE INVENTION

The present invention relates generally to a multi-function flashlight assembly that is configured in a manner that includes an integrated weapon mounting interface. More specifically, the present invention relates to a compact, high intensity, multi-purpose flashlight assembly that includes a high level of functionality in connection with an integrated weapon mounting interface, thereby making the flashlight capable of being utilized preferably as an accessory for a handgun wherein an accessory rail is provided ahead of the trigger guard, for example.

In the prior art, flashlights for use in military applications have typically been constructed in a standard fashion utilizing a tubular outer housing. As a consequence, in order to facilitate mounting of the flashlight onto other devices, such as military weapons, a relatively large mounting assembly was required. Usually, the prior art mounting assembly that is used in connection with a flashlight having conventional construction includes a heavy gauge band that is wrapped around the entire outer housing of the flashlight. In addition, these bands include projections from at least one side where a large thumbscrew is positioned to allow a user to tighten the band around the flashlight. The difficulty encountered with this construction is that in some cases it creates a greater opportunity for the flashlight and mounting assembly to be caught on clothing or brush while the firearm is being carried, thereby knocking the flashlight out of alignment, dislodging the flashlight from the firearm or damaging the flashlight. Further, the interface between the outer tubular housing and the mounting band leaves the potential that the flashlight may slide or rotate within the band requiring frequent repositioning. While this may be acceptable for a sport type firearm, it is not acceptable for a firearm employed for field use, such as hunting or combat environments where immediate, fully aligned use of the flashlight assembly is required.

Actuation of a flashlight retained in such a manner on the fire arm required a user to press a button at the rear of the flashlight in an axial manner. Such pressure not only contributes to the displacement of the flashlight within the mounting band but also requires a user to move their thumb in an awkward manner to operate the flashlight.

In environments wherein such flashlight accessories were mounted ahead of the trigger guard of a handgun, switches were provided that operated in a toggle fashion. The switch is typically a lever moves up or down about. The difficulty with the arrangement is that when a user is gripping a handgun with such an accessory attached, the motion required to operate the switch is a sideways finger motion. Such finger motion requires using the finger in a weak and awkward direction as ergonomically the users finger strength is in a front to back motion, not side to side.

Other difficulties with such flashlights include the fact that they were typically single function devices that had to be exchanged for a different flashlight should the need for an additional function arise, such as for example, in infra-red applications. In these situations, the user must carry several different lighting devices with them so that, as the need arises, the user can exchange lighting devices. In addition, should a flashlight include multi-functional features, often the controls are small and fussy making them difficult to operate in the typical military environment where the user is often wearing gloves. In these applications small buttons, sliders and knobs are nearly impossible to operate in a reliable fashion.

In view of the foregoing disadvantages inherent in the prior art devices, there is a need for an assembly that provides an improved method of compactly and reliably mounting a flashlight onto a firearm. There is a further need for an interfaceable flashlight assembly that is multi-functional, easy to operate and provides an improved engagement method for firearms that has the ability to consistently and quickly engage, and provide accurate alignment, while providing a reduced profile, thereby reducing potential interference with other devices and attachments. There is a further need for a device that provides multi-functionality in an improved flashlight construction that is easier to operate and exhibits a high degree of reliability even in the most rugged environment.

BRIEF SUMMARY OF THE INVENTION

In this regard, the present invention provides for a novel flashlight assembly that includes an interface integrated into the housing thereof to facilitate mounting of the flashlight to the interface positioned ahead of the trigger on a modern firearm. Generally, the outer body of the flashlight includes a head mounted to a flashlight body at one end and at least one paddle switch extending outwardly at the other end of the body. Preferably the paddle switch extends at least partially beyond a trigger guard on the firearm when the flashlight is mounted to the accessory interface on the firearm. Further, the flashlight includes protrusions extending from the side of the body for interfacing the flashlight with the accessory interface on the firearm.

Generally, modern type firearms include an interface rail integrated thereon for the mounting of auxiliary devices. The rail is known in the art as a Weaver or Picatinny type interface and takes the form of a rail having a dovetail cross-sectional profile that extends below the barrel and typically ahead of the trigger on the firearm. The outer housing of the flashlight includes such a clamping interface that is a seamless and integrated feature of the outer housing of the flashlight itself.

When the flashlight assembly is mounted onto a firearm the lower portion of the clamping interface is a dovetail that may be formed as a rigid profile that is simply slid onto the firearm accessory rail and retained in place using setscrews. In the alternative, the dovetail interface may be formed as a clamping assembly to engage the accessory rail on the firearm. In this configuration, the mounting interface may include a single tightening mechanism that engages both the second clamping arm that engages the flashlight and the rail interface clamp at the same time. Similarly, the mounting interface may have a separate dedicated clamping member for the dovetail interface. The tightening mechanism for both the clamping arm and the dovetail interface may be set screws, thumb screws, quick release type mechanisms or combinations thereof to allow easy mounting and demounting of the flashlight relative to the firearm. Further, a locking mechanism may be provided that serves to prevent accidental disengagement of the flashlight from the rail. In this embodiment such a lock is shown as a latch bar that extends across the clamp with a lever that when rotated tensions the latch bar and clamps against the rail.

Within the head portion there is a composite heat sink/reflector assembly to collect and dissipate the waste heat generated during operation of the flashlight. Adjacent a rear surface of the heat sink is positioned a circuit board that includes one or an array of at least two LEDs positioned thereon. In the preferred embodiment the LEDs include a visible white LED positioned centrally within the reflector. Optionally there may be an infra-red LED positioned adjacent the white LED and at the periphery of the opening in the reflector. This arrangement facilitates the use of a dual operational mode such that the output of the LEDs are maximized regardless of the mode in which the flashlight is being operated.

Further the flashlight may include one or more laser sighting modules in either visible red or green, infrared or a combination thereof. To facilitate easy operation the paddle switch may be broken into two switches such that a first operates the light and a second operates the laser. In this manner a user can easily control the function of the light using the paddles. It is preferred that the paddles operate in an ambidextrous or duplicate fashion such that the left and right paddles each function the same as its counterpart. This allows comfortable use on a handgun regardless of the shooter's handedness.

A selector switch may be provided on the light to toggle between visible and infrared modes.

Accordingly, it is an object of the present invention to provide a flashlight having a housing that includes a mounting interface that is integrated into the construction of its housing that provides an improved method of compactly and reliably mounting a flashlight onto a firearm. It is a further object of the present invention to provide an interfaceable flashlight assembly that is multi-functional, easy to operate and provides an improved engagement method for firearms that has the ability to consistently and quickly engage, and provide accurate alignment, while providing a reduced profile, thereby reducing potential interference with other devices and attachments. It is still a further object of the present invention to provide a device that provides multi-functionality in an improved flashlight construction that is easier to operate and exhibits a high degree of reliability even in the most rugged environment.

BRIEF DESCRIPTION OF THE DRAWINGS

In the drawings which illustrate the best mode presently contemplated for carrying out the present invention.

DETAILED DESCRIPTION OF THE INVENTION

Figure 1:
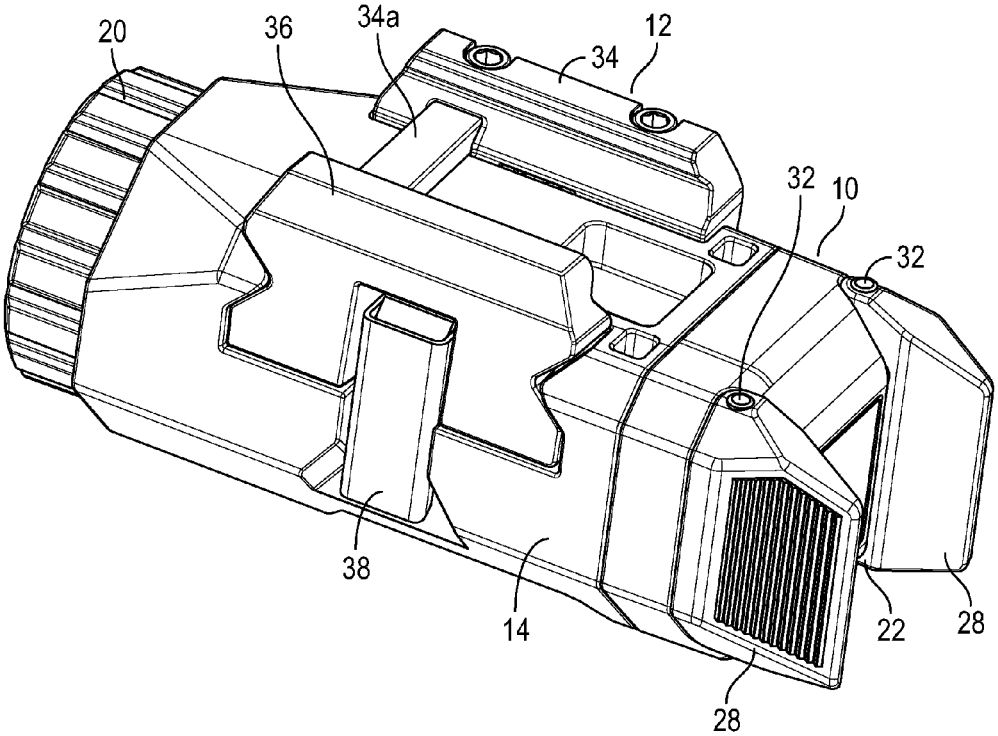
FIG. 1 is a side view of the flashlight assembly of the present invention.
Figure 2:
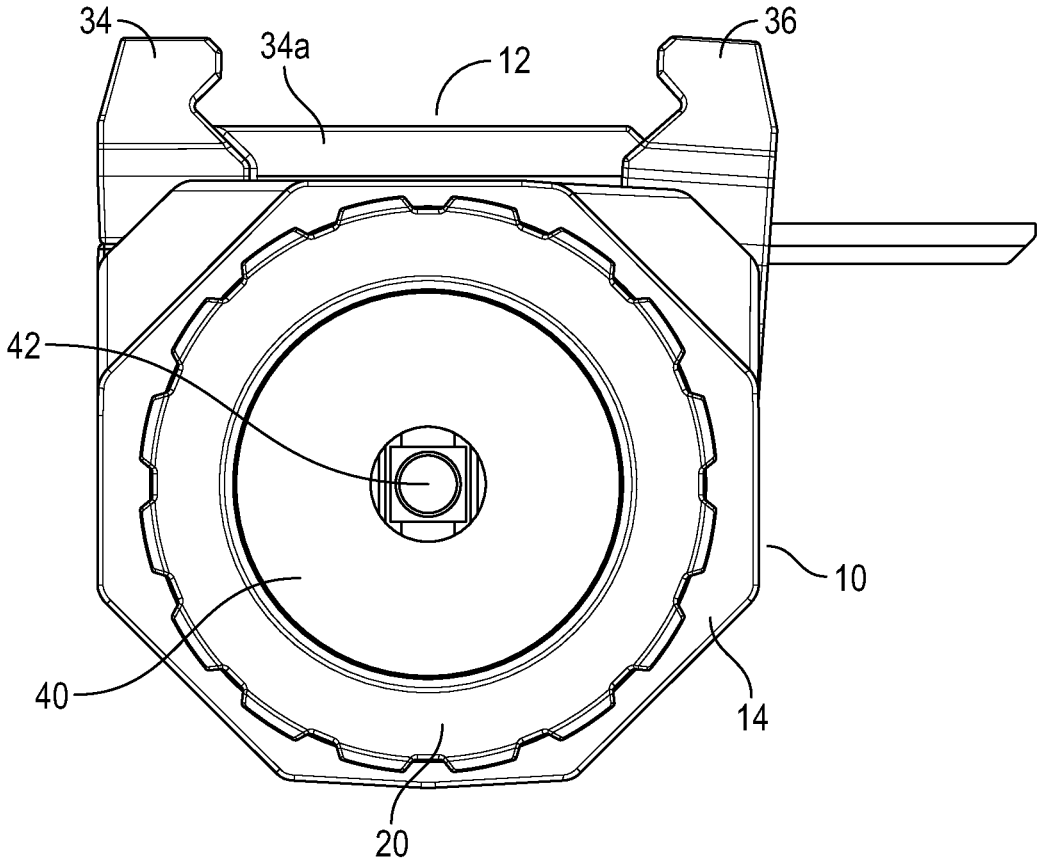
FIG. 2 is a front view of the flashlight assembly of the present invention.

Now referring to the drawings, a flashlight assembly is shown and generally illustrated in the figures. As can be seen in FIGS. 1 and 2, the flashlight assembly 10 includes an interface 12 integrated into the housing 14 thereof to facilitate mounting of the flashlight 10 to the dovetail rail 16 on a modern combat weapon and more preferably a handgun 18. Generally, the outer body of the flashlight 10 includes a head 20 mounted to a flashlight housing 14 body at one end and a switching mechanism 22 extending outwardly at the other end of the body. Further, the flashlight 10 includes protrusions extending from the side of the body that serve as an integrated interface 12 for interfacing the flashlight 10 with a firearm 18.

Figure 3:
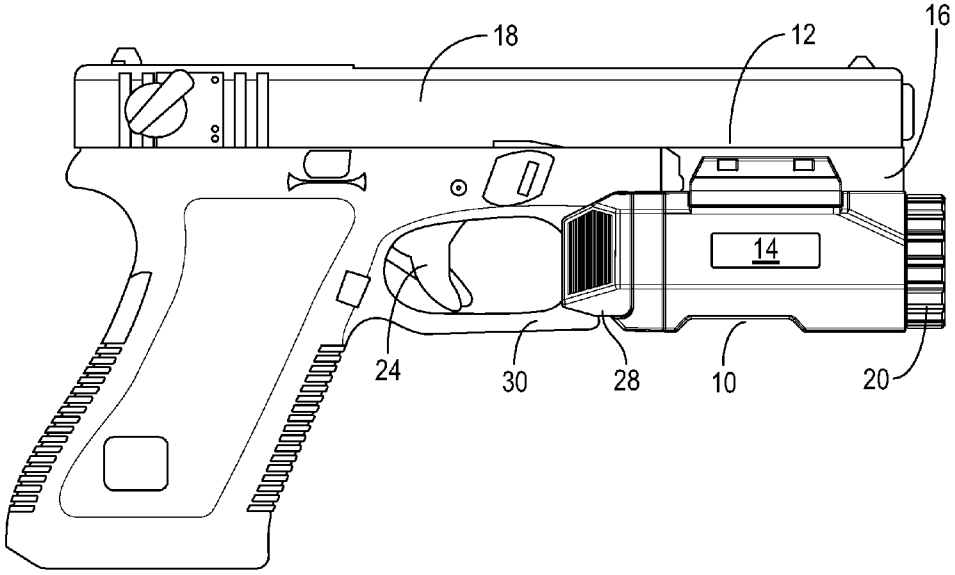
FIG. 3 is a side view of the flashlight assembly of the present invention affixed to a handgun.

As depicted at FIG. 3, modern type firearms generally include an interface rail 16 integrated thereon for the mounting of auxiliary devices. The rail is known in the art as a Weaver or Picatinny type interface and takes the form of a rail having a dovetail cross-sectional profile that extends below the barrel and typically ahead of the trigger 24 on the firearm 18. The outer housing 14 of the flashlight 10 includes such a clamping interface 12 that is a seamless and integrated feature of the outer housing of the flashlight itself. In this manner, the actuator for the light in the form of paddle switches 28 extend rearward adjacent the trigger guard 30 and may protrude slightly beyond the trigger guard 30 to make them convenient to operate.

Figure 4:
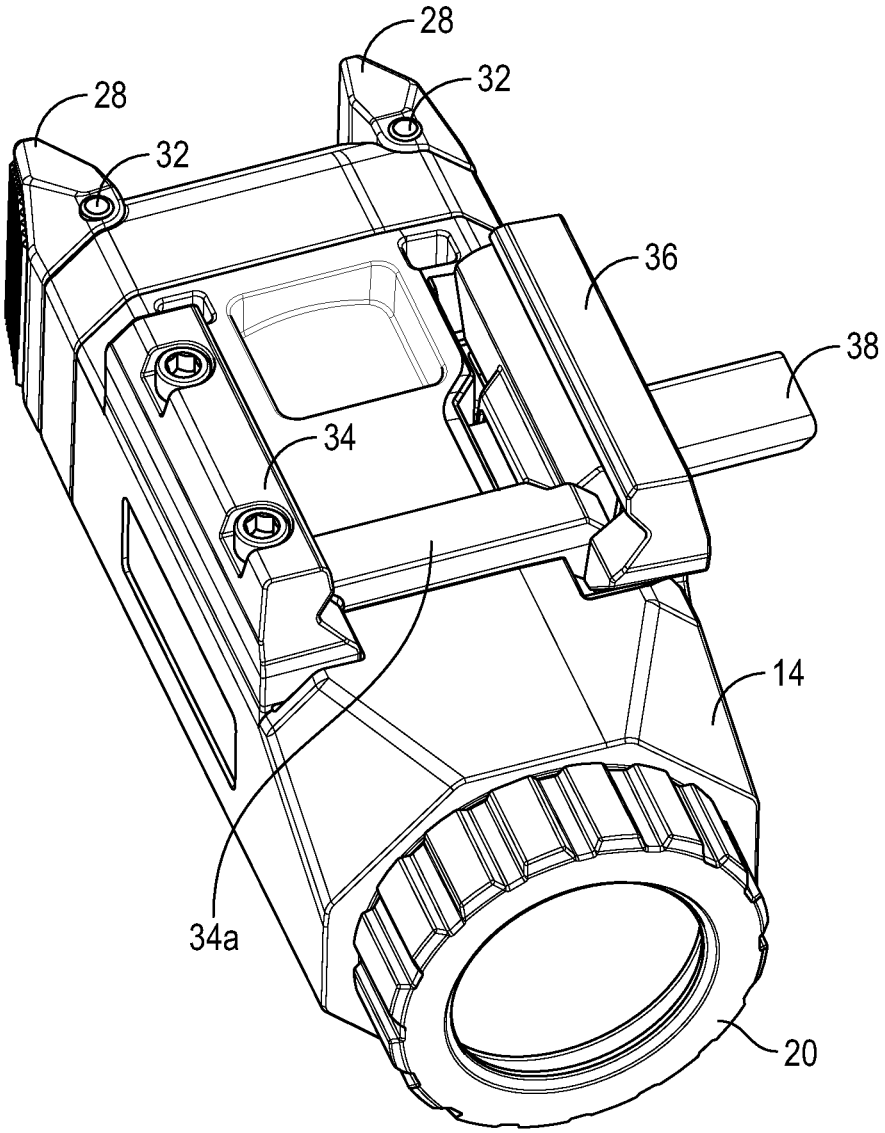
FIG. 4 is a top view of the flashlight showing the clamping assembly.

When the flashlight assembly is mounted onto a firearm the lower portion of the clamping interface is a dovetail that may be formed as a rigid profile that is simply slid onto the firearm accessory rail and retained in place using setscrews. In the alternative, as shown at FIG. 4, the dovetail interface may be formed as a clamping assembly 12 to engage the accessory rail on the firearm. In this configuration, the clamping interface may include a fixed clamping arm 34 and a single tightening mechanism 38 that engages the second movable clamping arm 36 that engages the flashlight and the rail interface clamp at the same time. Similarly, the mounting interface may have a separate dedicated clamping member for the dovetail interface. The tightening mechanism for both the clamping arm and the dovetail interface may be set screws, thumb screws, quick release type mechanisms or combinations thereof to allow easy mounting and demounting of the flashlight relative to the firearm. Further, in a preferred embodiment a locking mechanism may be provided that serves to prevent accidental disengagement of the flashlight from the rail. In this embodiment such a lock is shown as a latch bar that extends across the clamp with a lever that when rotated tensions the latch bar and clamps against the rail as will be discussed in greater detail below.

Figure 5:
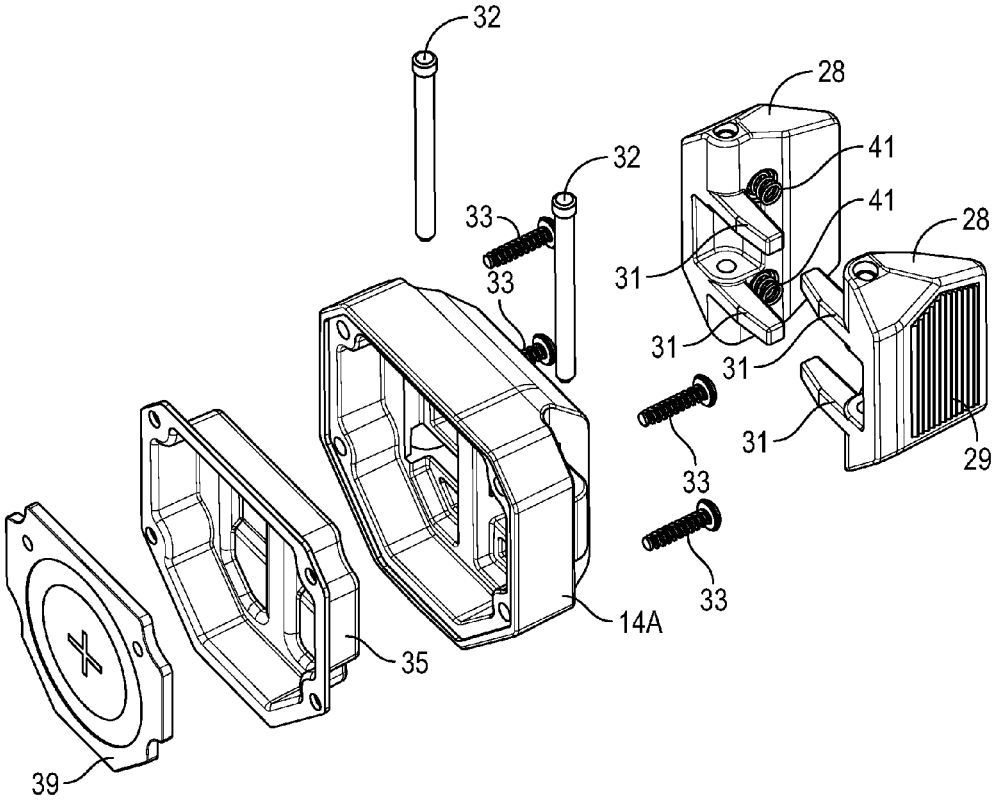
FIG. 5 is an exploded view of the switching assembly.
Figure 5A:
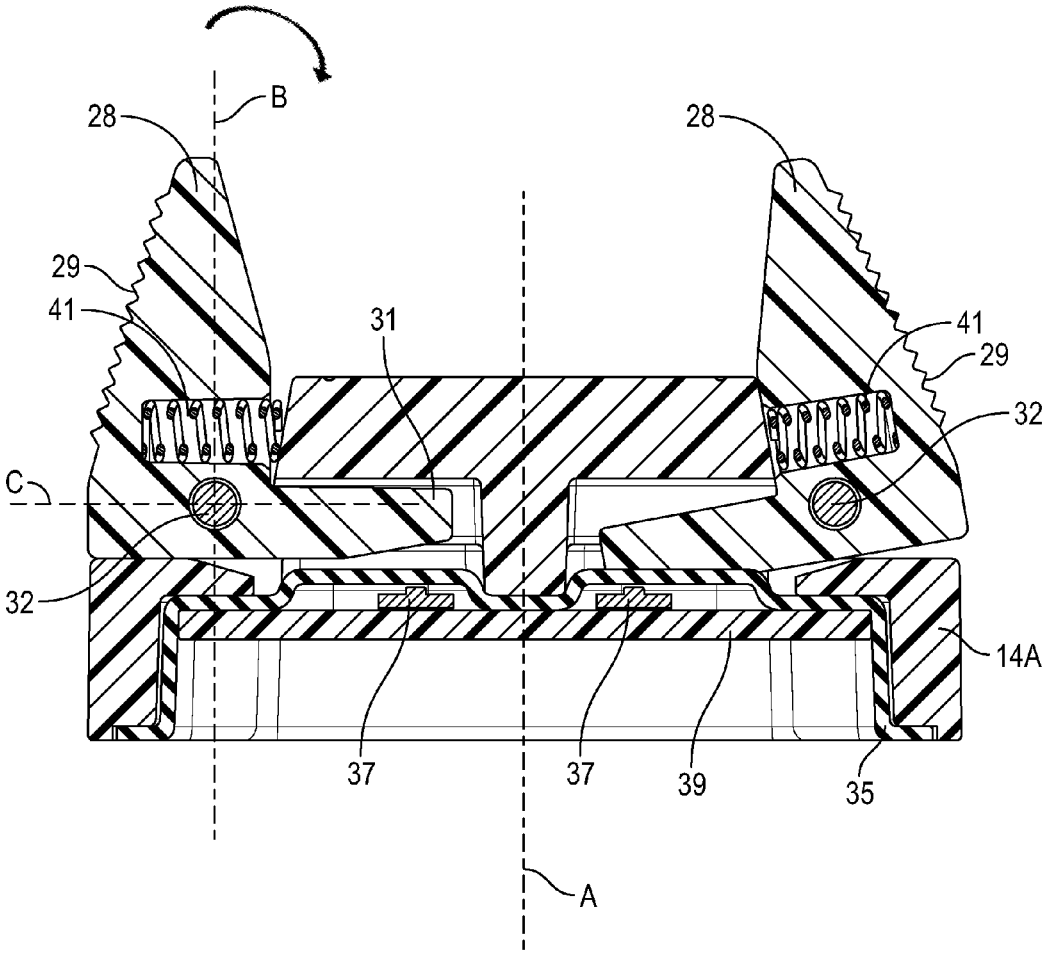
FIG. 5*a* is a cross-sectional view of the switching assembly.

Turning to FIGS. 5 and 5*a*, the operation of the flashlight of the present invention is highly ergonomic as compared to the flashlights of the prior art. Previously there was a lever that the user had to move up or down with an index finger. This motion required the user to engage the lever laterally with their finger. The difficulty is that there is little lateral strength in a person's finger, making operation difficult. Instead, the present invention employs a paddle switch 28 that is operated by the user pressing the pad of the user's trigger finger on a planar pad surface 29 at one end thereof. Since this motion is coincident with the user's gripping motion they have a great deal more strength, making operation intuitive and comfortable.

The operation of the paddle switch 28 is about a vertically oriented hinge point 32 that allows the paddles to extend in a vertical orientation, rearwardly adjacent the trigger guard. The paddle 28 includes an actuator arm 31 that extends from the end opposing the pad surface 29 and into a cap 14A at the rear of the flashlight housing 14 to cause the light to operate. The paddle switch 28 is movable about the hinge point 32 between an unactuated position (shown on the left side of FIG. 5*a*) and an actuated position (shown on the right side of FIG. 5*a*). Springs 41 contained within the paddle 28 (see FIG. 5*a*) are captured between the paddle 28 and the housing 14A and normally bias the paddle 28 to the unactuated position (left side of FIG. 5*a*). As seen on the right side of FIG. 5*a*, the paddle actuator arm 31 flexes a water seal cap 35 and presses a switch 37 that is located on a circuit board 39 contained within the cap 35. The cap 14A and water seal cap 35 are held to the main housing 14 with screws 33.

Returning to FIG. 2, within the head portion 20 there is a composite heat sink/reflector 40 assembly to collect and dissipate the waste heat generated during operation of the flashlight. Adjacent a rear surface of the heat sink is positioned a circuit board that includes one or an array of at least two LEDs positioned thereon. In the preferred embodiment the LEDs include a visible white LED 42 positioned centrally within the reflector 40. Optionally there may be one or more infra-red LEDs positioned adjacent the white LED and at the periphery of the opening in the reflector. This arrangement facilitates the use of a dual operational mode such that the output of the LEDs are maximized regardless of the mode in which the flashlight is being operated. A selector switch may be provided on the light to toggle between visible and infrared modes.

Figure 6:
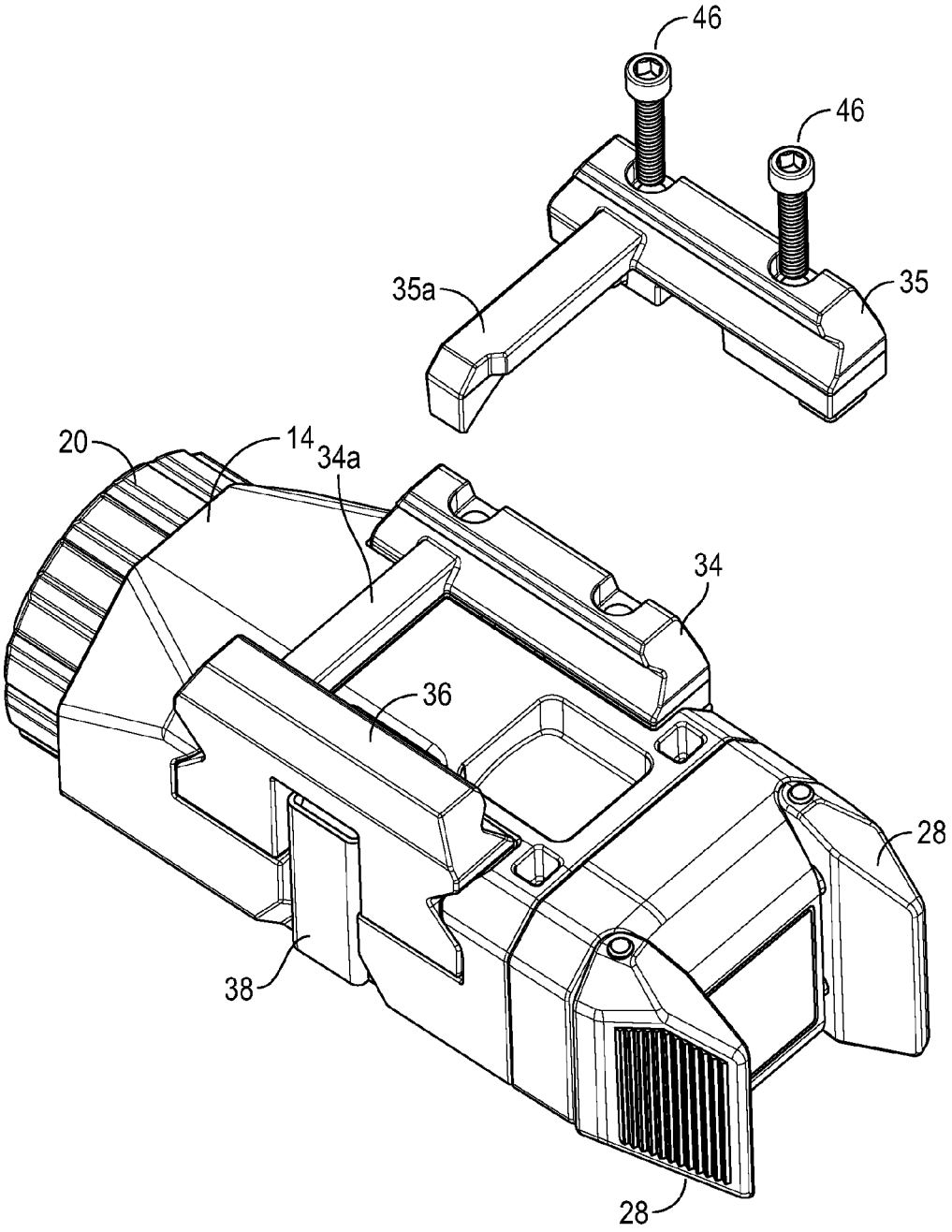
FIG. 6 is a top view of the flashlight showing the modular nature of the clamping assembly.

As can be seen at FIG. 6, different configurations of firearm accessory rails employ positioning slots thereon that vary in width. To accommodate this variation, the fixed side of the clamping assembly 34 including a cross bar member 34*a* is made to be modular and removable. In this manner the fixed side of the clamping assembly 34 can be removed along with the cross bar 34*a* and replaced with an alternate piece 35 having a cross bar 35*a* of a different width. In this manner interchangeable cross bar members and fixed sides of the clamping assembly can be removed and replaced simply by removing and replacing two screws 46 or other appropriate fasteners.

Figure 7:
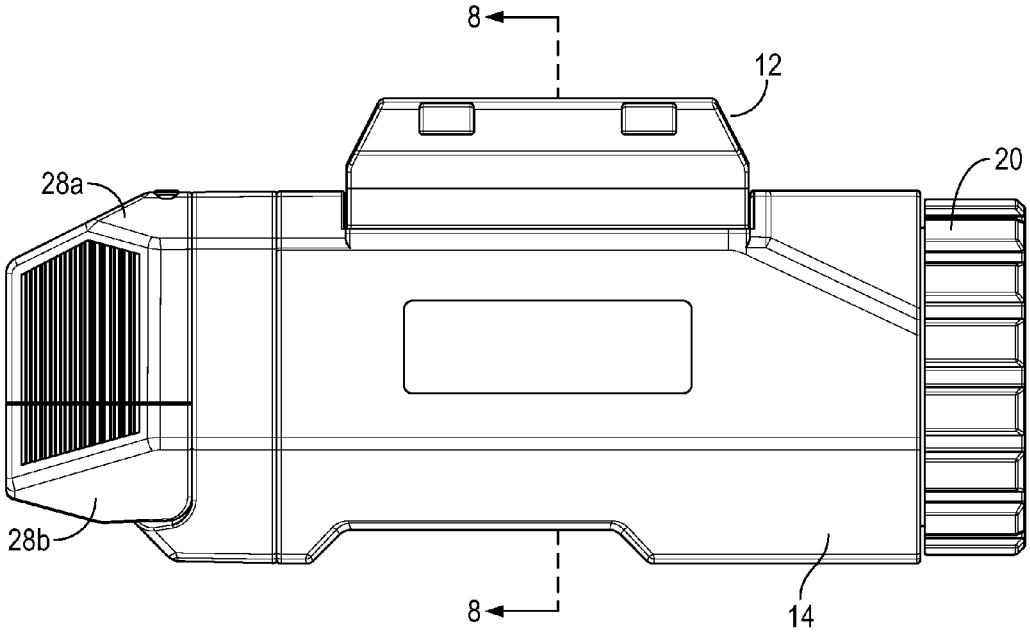
FIG. 7 is a side view of the flashlight showing an alternate switching configuration.

Further the flashlight may include one or more laser sighting modules in either visible red or green, infrared or a combination thereof. As shown at FIG. 7, to facilitate easy operation the paddle switch may be broken into two switches such that a first paddle switch 28*a* operates the light and a second paddle switch 28*b* operates the laser. In this manner a user can easily control the function of the light using the paddles. It is preferred that the paddles operate in an ambidextrous or duplicate fashion such that the left and right paddles each function the same as its counterpart. This allows comfortable use on a handgun regardless of the shooter's handedness.

Figure 8A:
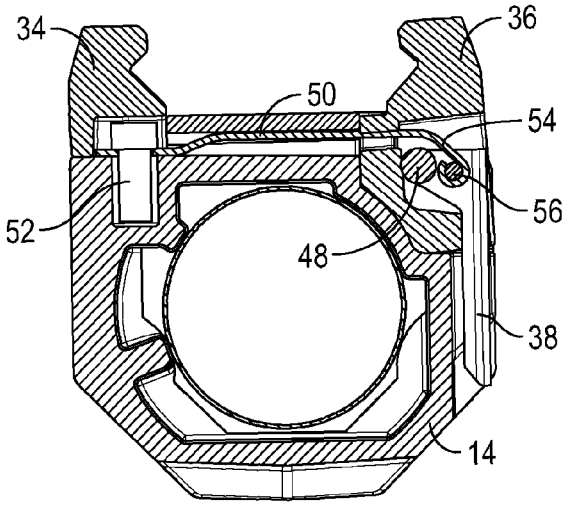
FIGS. 8*a*, 8*b* and 8*c* are cross sectional views taken along the line 8-8 of FIG. 7 depicting the operational positions of the clamping assembly.
Figure 8B:
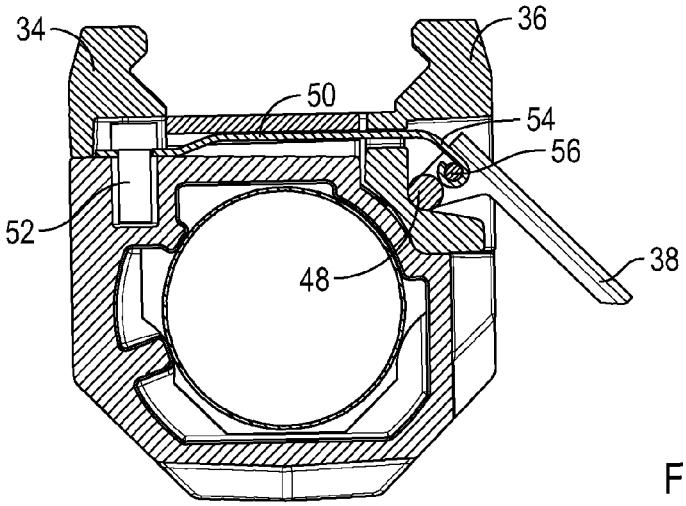
Figure 8C:
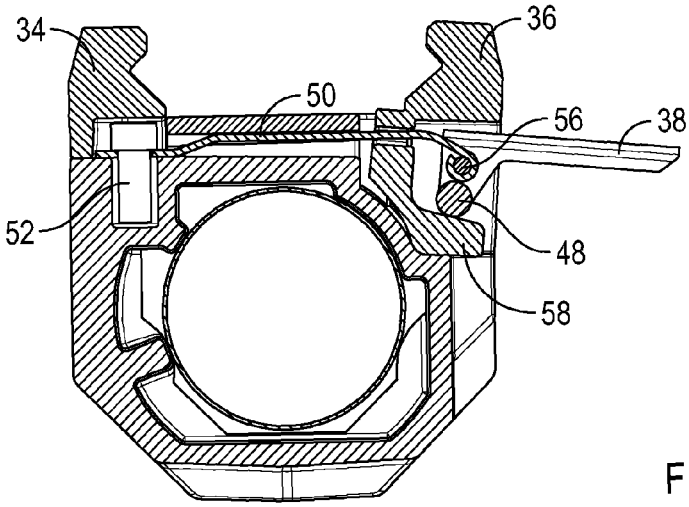

The operation of the clamping mechanism is depicted at FIGS. 8*a*, 8*b* and 8*c*. The clamp at FIG. 8*a* is shown fully engaged. The actuator lever 38 is pressed against the body of the flashlight such that the front roller 48 on the lever presses the movable clamping arm 36 against the firearm accessory rail. The clamping force is generated by the lever arm 38 drawing tension against the spring band 50 that is pinned 52 across the clamping assembly. Further, the offset 54 in the spring band 50, in combination with the elevational offset in the roller pin 48 and retainer pin 56 causes a tactile engaging force as the lever is depressed and the clamp is engaged. These offsets cause the clamp to snap shut and serves to retain the lever arm in a closed position.

As can be seen at FIG. 8*b*, as the lever arm 38 is opened against the spring force, the lever arm 38 comes to a neutral position once the retainer pin 56 is displaced above the roller pin 48 allowing the spring force generated by the two offsets to be released. In this neutral position, while the movable clamping arm is still substantially closed, the clamping force is released.

Finally, at FIG. 8*c*, the lever arm 38 is lifted upwardly such that the roller pin 48 presses down on the lower portion 58 of the movable clamping arm 36 causing it to displace outwardly relative to the flashlight body. This displacement causes the clamping arm to open and allows the flashlight to be installed onto or removed from the firearm accessory rail.

It should be appreciated by one skilled in the art that while the clamping assembly is shown here in the context of a flashlight, the clamping assembly can be used in connection with any accessory for the purpose of mounting on a firearm. The clamping assembly could be integrated to laser sights, optics, lights, risers, handles, pistol grips or any other device attached to a firearm. Further, the clamping assembly could be made to include a base to which any accessory may be screwed or mounted and still fall within the scope of the present disclosure.

Accordingly, it can be seen that the present invention provides a flashlight having a housing that includes a mounting interface that is integrated into the construction of its housing that provides an improved method of compactly and reliably mounting a flashlight onto a firearm that is multi-functional, easy to operate and provides an improved engagement method for firearms that has the ability to consistently and quickly engage, and provide accurate alignment, while providing a reduced profile, thereby reducing potential interference with other devices and attachments. It can be further seem that the present invention provides a device that includes multi-functionality in an improved flashlight construction that is easier to operate and exhibits a high degree of reliability even in the most rugged environment. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A flashlight for use with a pistol, the pistol having a trigger guard and a mounting rail extending forwardly of the trigger guard, said flashlight comprising:

a housing having a light source disposed at a first end thereof and further having a switching mechanism disposed at an opposing second end thereof, said housing having a longitudinal axis extending between said first and second ends thereof;

a mounting rail clamping assembly extending from said housing wherein said switching mechanism is located adjacent a forward end of said trigger guard when said mounting rail clamping assembly is secured to said mounting rail, said switching mechanism including a switch and a paddle actuator, said paddle actuator having a paddle portion with an outwardly facing pad surface at one end thereof, said paddle actuator further having an actuator arm portion at an opposing end thereof, said paddle actuator being mounted on a hinge pin which has an axis perpendicular to said longitudinal axis of said housing, whereby said paddle portion extends rearwardly adjacent to a side of a forward end of said trigger guard, said paddle portion extending rearwardly from said hinge pin in a plane which runs parallel to said longitudinal axis of said housing, said actuator arm portion extending inwardly from said hinge pin in a plane which extends perpendicular to said longitudinal axis of said housing, said paddle actuator being hingeably movable about said hinge pin between an unactuated position wherein said paddle portion extends rearward, said actuator arm portion extends inwardly and said actuator arm portion is spaced from said switch, and an actuated position wherein said paddle portion is pivoted inwardly toward said trigger guard in response to engagement of the pad surface by a user, and said actuator arm portion is pivoted rearwardly toward said switch, and said actuator arm portion engages said switch, said switching mechanism further including a spring captured between said paddle actuator and said housing, said spring normally biasing said paddle actuator to said unactuated position.

2. The flashlight of claim 1, wherein said pad surface is substantially planar.

3. The flashlight of claim 1 further comprising opposing switching mechanisms with opposing paddle actuators, wherein said paddle portions of said paddle actuators extend rearwardly on opposing sides of said trigger guard.

4. The flashlight of claim 3, wherein said pad surfaces are substantially planar.

5. The flashlight of claim 1, further comprising a selector switch for controlling an operational mode of said flashlight.

6. A flashlight for use with a pistol, the pistol having a trigger guard and a mounting rail extending forwardly of the trigger guard, said flashlight comprising:

a housing having a light source disposed at a first forward end thereof and further having a switching mechanism disposed at a second rearward end thereof, said housing having a longitudinal axis extending between said first and second ends thereof;

a mounting rail clamping assembly extending from said housing, wherein said switching mechanism is located adjacent a forward end of said trigger guard when said mounting rail clamping assembly is secured to said mounting rail, said switching mechanism including a switch and an L-shaped paddle actuator, said paddle actuator having a paddle portion with an outwardly facing pad surface at one end thereof, said paddle actuator further having an actuator arm portion at an opposing end thereof, said paddle actuator being mounted on a hinge pin which has an axis extending perpendicular to said longitudinal axis of said housing, whereby said paddle portion extends rearwardly adjacent to a side of a forward end of said trigger guard, said paddle portion extending rearwardly from said hinge pin in a plane which runs parallel to said longitudinal axis of said housing, said actuator arm portion extending inwardly from said hinge pin in a plane which extends perpendicular to said longitudinal axis of said housing, said actuator arm portion being adjacent to said switch, said paddle actuator being hingeably movable about said hinge pin whereby said paddle portion pivots inwardly toward said trigger guard and said actuator arm portion pivots forwardly to engage said switch.

7. The flashlight of claim 6, wherein said pad surface is substantially planar.

8. The flashlight of claim 7 further comprising opposing switching mechanisms with opposing paddle actuators, wherein said paddle portions of said paddle actuators extend rearwardly on opposing sides of said trigger guard.

9. The flashlight of claim 8, wherein said pad surfaces are substantially planar.

10. The flashlight of claim 6, further comprising a selector switch for controlling an operational mode of said flashlight.

11. The flashlight of claim 1, wherein said light source is selected from the group consisting of: a white light source, a visible light source, an infra-red light source, and a laser light source.

12. The flashlight of claim 6, wherein said light source is selected from the group consisting of: a white light source, a visible light source, an infra-red light source, and a laser light source.

* * * * *